United States Patent [19]

Verdenne

[11] Patent Number: 4,530,281

[45] Date of Patent: Jul. 23, 1985

[54] SMALL SIZE STAMPING DEVICE

[75] Inventor: Jean Verdenne, Paris, France

[73] Assignee: Societe Nouvelle Terseram-Megras, Vincennes, France

[21] Appl. No.: 578,611

[22] Filed: Feb. 13, 1984

Related U.S. Application Data

[63] Continuation of Ser. No. 377,594, May 12, 1982, abandoned.

[30] Foreign Application Priority Data

May 25, 1981 [FR] France ..... 81 10336

[51] Int. Cl.[3] ..... B41J 27/02

[52] U.S. Cl. ..... 101/104; 101/334; 118/264

[58] Field of Search ..... 118/264, 266, 267, 265, 118/268, 269, 270; 15/185, 203; 101/333, 327, 97, 98, 104, 105, 405, 324, 334

[56] References Cited

U.S. PATENT DOCUMENTS

| | | | |
|---|---|---|---|
| 193,187 | 7/1877 | Scott . | |
| 317,853 | 5/1885 | Richford . | |
| 396,233 | 1/1889 | Reynolds . | |
| 1,085,143 | 1/1914 | Malsch . | |
| 1,166,296 | 12/1915 | Wolfe | 15/185 |
| 1,889,182 | 11/1932 | Rosenberg | 15/203 |
| 4,277,195 | 7/1981 | Huslik . | |

FOREIGN PATENT DOCUMENTS

| | | | |
|---|---|---|---|
| 35964 | 7/1886 | Fed. Rep. of Germany . | |
| 626334 | 7/1949 | United Kingdom | 15/185 |

OTHER PUBLICATIONS

"Klick" Stamp (a schematic illustration of such stamp is enclosed; also, samples of the stamp are available from applicant's attorney).

*Primary Examiner*—John P. McIntosh

*Attorney, Agent, or Firm*—Wenderoth, Lind & Ponack

[57] ABSTRACT

A stamping device includes a stamp, with an inking pad or of the self-inking type, for printing or marking documents or objects, and a box, containing the stamp. The stamp is fixed on a part which retracts under a box cover and is mounted on the cover so that the cover is used as a single control member for moving the stamp into position for use and, after use, automatically retracting the stamp into the box. The part on which is fixed the stamp is slidably mounted on the cover by virtue of two grooves formed in the cover and into which extend engagement protrusions such as studs formed on the part.

11 Claims, 2 Drawing Figures

SMALL SIZE STAMPING DEVICE

This application is a continuation of now abandoned application Ser. No. 377,594, filed May 12, 1982, now abandoned.

FIELD AND OBJECTS OF INVENTION

The present invention relates to a stamping device for the printing or marking of objects or documents, and is in the form of a reduced size box adapted for being easily kept in the pocket of a garment. The device includes a stamp movable into a use position protruding outside the box and retractable, after use, inside the box, automatically by the action of a simple thrust exerted on a cover of the box.

According to the invention, the stamp, with an inking pad or self-inking, is fixed on a support which folds up, under the box cover, so that the cover is used as a unique control member for moving the stamp into position for use, or after use, automatically reinserting the stamp into the box.

Various features and advantages of the invention will become apparent from the following description of one embodiment thereof.

It is pointed out that this embodiment is given only by way of example and that any other shapes, proportions and dispositions could be adapted without departing from the scope of the invention.

BRIEF DESCRIPTION OF DRAWINGS

For the following description, reference is made to the accompanying drawings wherein.

DETAILED DESCRIPTION OF THE INVENTION

The invention includes a box-shaped casing a, of small size, notably of shallow depth, adapted for being easily kept in the pocket of a garment.

According to the invention, a stamp b which, in the example discussed, is an ordinary stamp inked by a pad c is fixed, for example by gluing, on a part d which forms a stamp support. The support part d is slidably mounted on a cover e by virtue of two slots or ramps $e_1$ formed on the cover. The ramps are engaged by studs g provided on part d.

The cover e is on the other hand mounted about axes f on the case a so as to be pivotable under the action of a thrust exerted in the direction of arrow $f_1$.

By exerting a thrust on cover e in the direction shown by arrow $f_1$, part b is lifted by being tilted, as the studs g progress along the ramps $e_1$.

During such movement, the part d carrying the stamp b pivots outwardly and is exposed such movement guided by the studs g progressing along the ramps $e_1$. At the end of such movement, the studs stop in groove-shaped notches h in the ends of the ramps, thus housing the studs. Moreover, protrusions $e_2$ of the cover come in engagement inside the grooves $a_1$ of the box.

Figure 1:
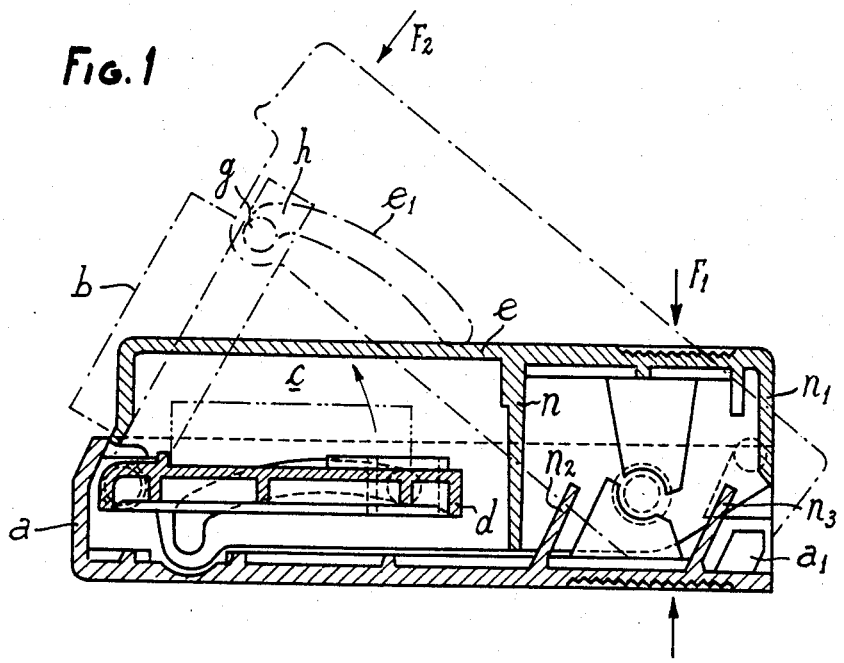
FIG. 1 is a sectional view of the apparatus of the invention.
Figure 2:
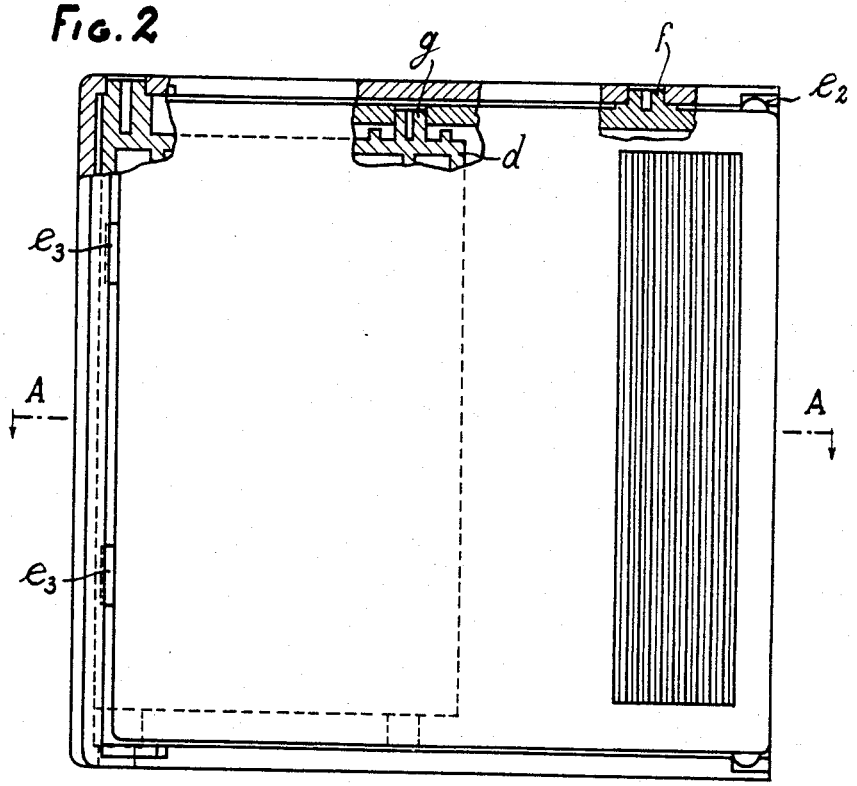
FIG. 2 is a plan view, partially broken away, of the apparatus according to the invention.

Under such conditions, the stamp is in position for being used, as is shown by the chain-dot lines in FIG. 1, in which position it is locked by the hereabove described means.

In order to provide for retraction of the stamp into the box, it is enough to exert a thrust on the cover, in the direction of arrow $f_2$ and to press. Thereby is provided the unlocking of the support part d from its position of use, then its automatic retraction under cover e. The moving of the cover into its closing position in the box is completed by two small beaks $e_3$ on the cover which come in a snap-in engagement inside the box a.

The tighteness of the box is ensured by a set of ribs n, $n_1$, $n_2$, $n_3$ provided respectively in the cover and in the bottom of the box, forming baffles opposing the penetration of dust inside the box.

The example discussed relates to the case of an ordinary stamp, impregnated by an inking pad.

Where a self-inking stamp is used, the shape and arrangement of the box are the same. Self-inking stamps are different from ordinary stamps in that the ink is kept captured inside the stamp and not in a separate cushion. A self-inking stamp is therefore thicker than an ordinary stamp. In this case, what is needed is only to omit the inking pad c of the box and to glue a self-inking stamp onto part d, in the same manner as an ordinary stamp.

I claim:

1. A stamping device comprising:

a box-shaped casing having an open top;

a cover hinged to said casing adjacent a first end thereof for pivotal movement with respect thereto between a first position closing said open top of said casing and a second position opening said open top of said casing;

a support hinged to said casing adjacent a second end thereof for pivotal movement with respect thereto between an extended position and a retracted position;

a stamp mounted on said support for pivotal movement therewith;

said cover and said support having cooperating guide means for, upon pressure being applied to said cover adjacent a first end thereof to cause said cover to pivot from said first position thereof to said second position thereof, automatically causing said support to pivot from said retracted position thereof to said extended position thereof, whereat said stamp is in an exposed position for use, and for, upon pressure being applied to said cover adjacent a second end thereof to cause said cover to pivot from said second position thereof to said first position thereof, automatically causing said support to pivot from said extended position thereof to said retracted position thereof, whereat said stamp is enclosed within said casing by said cover, said guide means comprising grooves formed in said cover, and studs extending from said support into said grooves; and means for retaining said support in said extended position thereof and for retaining said cover in said second position thereof.

2. A device as claimed in claim 1, wherein said support is hinged to said casing adjacent a first end of said support, and said studs are located at positions adjacent a second end of said support.

3. A device as claimed in claim 1, wherein said means for retaining said support in said extended position thereof comprises notches at ends of said grooves, said studs extending into said notches when said support is in said extended position thereof.

4. A device as claimed in claim 3, wherein said means for retaining said cover in said second position thereof comprises protrusions extending from said cover, and recesses in said casing adjacent said first end thereof, said protrusions fitting into said recesses when said cover is in said second position thereof.

5. A device as claimed in claim 1, further comprising beaks on said cover adapted for snapping engagement with said casing when said cover is pivoted to said first position thereof.

6. A device as claimed in claim 1, further comprising ribs extending from said cover and from said casing for improving the air tightness of said device when said cover is in said first position thereof.

7. A device as claimed in claim 1, further comprising an ink pad mounted on said cover at a position to be in contact with said stamp when said cover is in said first position thereof.

8. A device as claimed in claim 1, wherein said stamp is of the self-inking type.

9. A stamping device comprising:

a shallow box composed of mutually confronting casing and cover parts hinged together on an axis near a backward end thereof so as to be pivotable each relative to the other about said axis, by finger pressure on their backward ends, between a closed position in which they fit together to enclose a stamp and a stamp inking pad and an open position in which their forward ends are spaced apart;

a stamp support platen hinged near one edge thereof to a forward end portion of said casing part for pivotal movement between a retracted position in which said platen lies along and inside said casing and an extended position in which it bridges the space between and interconnects the forward ends of said parts in open position; and interengaged guide track means and cam follower means respectively on said cover part and on said platen near an edge thereof opposite said one edge for positively displacing said platen from said retracted position to said extended position in response to pivotal movement of said parts from said closed position to said open position, and for positively displacing said platen to said retracted position in response to pivotal movement of said parts from said open position to said closed position, said guide track means having an end portion which coacts with said cam follower means in said extended position of said platen to prevent displacement of said platen from said extended position by forces in the direction normal to said platen.

10. A stamping device according to claim 9, said casing part comprising a bottom wall bordered by relatively upright side walls, said guide track means comprising slots formed in opposite side walls of said cover part, said cam follower means comprising studs protruding into said slots from opposite end edge portions of said platen.

11. A stamping device according to claim 10, said slots each comprising an arcuate slot portion leading into a laterally offset notch near the forward end of said casing part, said studs being disposed in said notches in said extended position of said platen so as to prevent displacement of said platen from said extended position by forces in the direction normal to said platen.

* * * * *